US006864461B2

(12) United States Patent
Okabayashi et al.

(10) Patent No.: US 6,864,461 B2
(45) Date of Patent: Mar. 8, 2005

(54) FIXING DEVICE FOR IMAGE FORMING APPARATUS

(75) Inventors: Eiji Okabayashi, Toyokawa (JP); Takashi Kidokoro, Shinshiro (JP)

(73) Assignee: Minolta Co., Ltd., Osaka (JP)

( * ) Notice: Subject to any disclaimer, the term of this patent is extended or adjusted under 35 U.S.C. 154(b) by 52 days.

(21) Appl. No.: 10/400,789

(22) Filed: Mar. 28, 2003

(65) Prior Publication Data

US 2003/0183610 A1 Oct. 2, 2003

(30) Foreign Application Priority Data

Mar. 28, 2002 (JP) ..... 2002-090472
Jul. 26, 2002 (JP) ..... 2002-218102
Jul. 26, 2002 (JP) ..... 2002-218457

(51) Int. Cl.[7] ..... G03G 15/20

(52) U.S. Cl. ..... 219/216; 219/653; 399/69; 399/329

(58) Field of Search ..... 219/216, 601, 219/618, 619, 653, 654; 399/69, 329, 336, 338

(56) References Cited

U.S. PATENT DOCUMENTS 4,565,439 A * 1/1986 Reynolds ..... 399/329
5,278,618 A * 1/1994 Mitani et al. ..... 399/329
5,752,148 A 5/1998 Yoneda et al.
6,343,195 B1 * 1/2002 Abe et al. ..... 399/69
6,449,457 B2 * 9/2002 Samei et al. ..... 399/329
6,591,082 B2 * 7/2003 Samei et al. ..... 399/329
6,631,253 B2 * 10/2003 Nakafuji et al. ..... 399/329
6,721,530 B2 * 4/2004 Hirst et al. ..... 219/619
6,792,238 B2 * 9/2004 Samei et al. ..... 399/329
2003/0063931 A1 * 4/2003 Sanpei et al. ..... 399/329

FOREIGN PATENT DOCUMENTS

JP 05-107961 4/1993
JP 08-137306 5/1996
JP 09-160206 6/1997
JP 2001-343849 12/2001
JP 2002333788 A * 11/2002

* cited by examiner

*Primary Examiner*—Joseph Pelham
(74) *Attorney, Agent, or Firm*—Burns, Doane, Swecker & Mathis, L.L.P.

(57) ABSTRACT

A belt-type fixing device for an image forming apparatus is capable of raising a temperature to a level suitable for a fixing process in a short period of time with high heating efficiency. A fixing belt is entrained in spanning relation between a heating plate providing a heat generator on the inner surface of the semi-cylindrical plate and a pressing pad disposed at a distance from the heating plate. A pressing roller is disposed at a position opposing the pressing pad. The fixing belt is revolved by rotating the pressing roller. A recording medium having a toner adhered thereto is caused to pass through a nip portion of the fixing belt and the pressing roller.

23 Claims, 17 Drawing Sheets

Fig. 7(a)
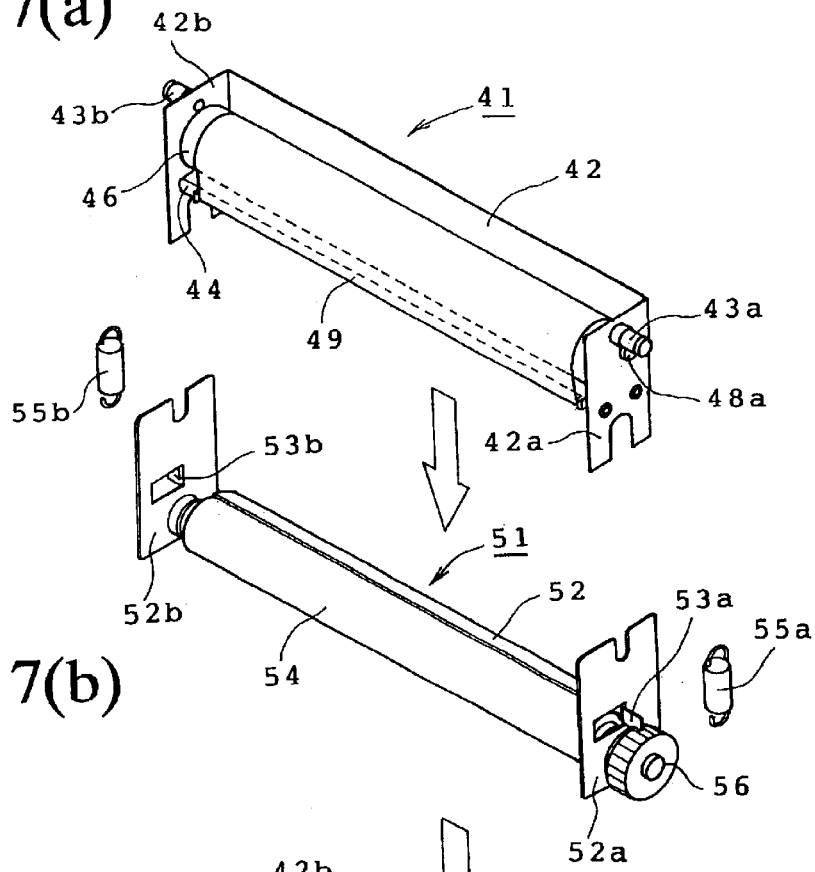
Fig. 7(b)
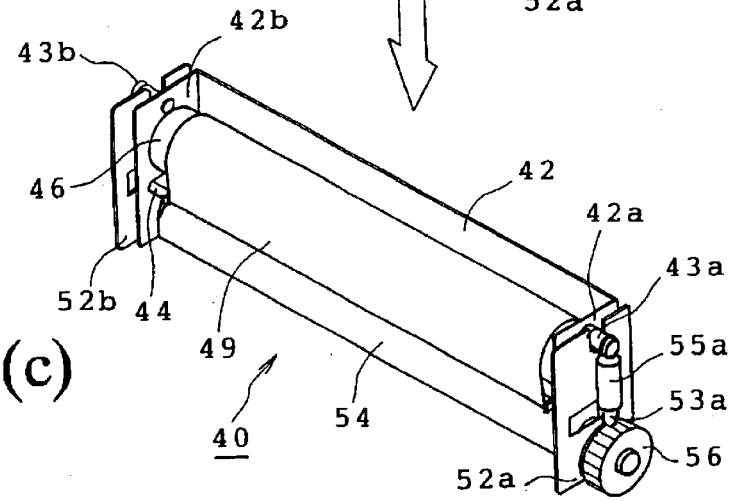
Fig. 7(c)

FIXING DEVICE FOR IMAGE FORMING APPARATUS

This application is based on application(s) No(s). 2002-90472, 2002-218102, and 2002-218457 filed in Japan, the contents of which are hereby incorporated by reference.

BACKGROUND OF THE INVENTION

1. Field of the Invention

The present invention relates to a fixing device for an electrophotographic image forming apparatus such as an electrophotographic copier or printer.

2. Prior Art

In a conventional electrophotographic image forming apparatus such as an electrophotographic copier or printer, a latent image of an original image is formed by uniformly charging a photosensitive member and exposing the original image on the photosensitive member. The formed latent image is developed with a toner to form a toner image of the original image, which is transferred onto a recording medium or transferred onto an intermediate transfer member and then further transferred onto the recording medium. The transferred toner image is subjected to a heat fixing process performed by a fixing device, whereby image formation is accomplished.

Examples of the fixing device include a fixing device of fixing-roller type and a fixing device of fixing-belt type. In the fixing device of fixing-roller type, a heating roller internally provided with a heat source and a pressing roller are disposed in opposing and contact relation. A fixing process is performed by causing a recording medium having a toner image transferred thereon to pass through a nip portion between the heating roller and the pressing roller and thereby fixing a toner image.

The aforementioned conventional fixing device of fixing-roller type has the disadvantage of a long waiting time from the time of power-on until a temperature at which a fixing process can be performed is reached in addition to the problems of large energy consumption for constantly holding the heating roller at a high temperature and temperature elevation within the fixing device due to heat dissipation from the fixing device into an image forming apparatus even during standby.

In the fixing device of fixing-belt type, on the other hand, the fixing belt is entrained in spanning relation between a heating roller internally provided with a heating source and a winding roller such that the heat of the heating roller is transmitted to the fixing belt. A fixing process is performed by causing a recording medium having a toner image transferred thereon to pass through a nip portion between a pressing roller disposed in opposing relation to the winding roller and the fixing belt and thereby heat pressing the toner image. Accordingly, it is no more necessary to provide a heat source at the nip portion, specifically within the fixing roller, which has been provided in the conventional fixing device and to effect heat conduction from inside the fixing roller, which has been effected conventionally. This allows a low-hardness elastic layer with a low heat conductivity to be provided at the nip portion and the provision of the low-hardness elastic layer ensures the provision of the nip portion with a large width.

An example of such a belt-type fixing device is disclosed in Japanese Patent Application Laid-open No. 137306/1996. The technology disclosed therein disposes a fixing belt in entrained and spanning relation between two rotating rollers, opposing an electromagnetic induction coil to the belt entrained in spanning relation between the rollers, and directly heats the belt with the electromagnetic induction coil. Since the rollers revolve the belt on receiving the tension of the belt, they should have a relatively large strength, which increases the heat capacity of the rollers. The heat given to the belt partly flows to the roller. Because of the large heat capacity, the heat of the belt is partly taken by the rollers so that the reduction of a warm-up time is approaching a limit even if efficient heating is performed by electromagnetic induction.

As disclosed in Japanese Patent Application Laid-open No. 107961/1993, on the other hand, an approach to reducing the warm-up time by bringing a heater into sliding contact with an outer surface of a heating roller and thereby performing heating has been made. However, the approach has the problem of low durability since the surface in sliding contact with the heater is a fixing surface and therefore is prone to flaws.

Another approach to direct heating performed by disposing a non-rotating heater at the nip portion has also been made. However, since a heater is required to have a pressing function and a heating function, the nip portion cannot have a sufficiently large width. In addition, the problem of high cost is also encountered since highly accurate dimensions and assembly are required of a heater holding member and the heater.

There has also been proposed a fixing device of fixing-belt type having a structure in which a non-rotating semi-cylindrical, i.e., trough-like heating plate is used in place of the heating roller and a fixing belt is entrained in spanning relation between the semi-cylindrical heating plate and a winding roller (see Japanese Patent Application Laid-open No. 343849/2001). Since the diameter of the non-rotating semi-cylindrical heating plate used in place of the heating roller corresponds to substantially half the diameter of the heating roller, the structure offers the advantages of a reduced lateral dimension of the fixing device and easy scaling down of the fixing device. Since a sheet-like heat generator as a heat source can be affixed directly to the inner surface of the trough-like heating plate, the structure also offers the advantages of high heat transmission efficiency, a reduced standby time, and the like.

In the foregoing fixing device of fixing-belt type using the semi-cylindrical heating plate, however, the inner surface of the semi-cylindrical heating plate is open so that heat is radiated uselessly. The radiated heat not only reduces heat efficiency but also renders the fixing device unsatisfactory in terms of safety. In inspecting the fixing device, the inspector may suffer a burn by mistake.

The present invention has been achieved to solve the foregoing problems and it is therefore an object of the present invention to provide a compact and low-cost fixing device of fixing-belt type which uses a heating plate in place of a heating roller to reduce a waiting time from the time of power-on until a temperature at which a fixing process can be performed is reached, ensure the supply of heat from the heating plate to the fixing belt, and give a proper tension to the fixing belt during a fixing operation.

SUMMARY OF THE INVENTION

1. A primary object of the present invention is to provide a fixing device of fixing-belt type which is capable of promptly heating the fixing belt to an operating temperature proper for a fixing process by using a heating plate with a novel structure which allows efficient heat transmission to the fixing belt.

2. Another object of the present invention is to provide a fixing device of fixing-belt type with reduced energy consumption which is capable of promptly heating a fixing belt to an operating temperature proper for a fixing process by using a compact and light-weight heating plate with a novel structure which is low in heat capacity.

3. Still another object of the present invention is to provide a compact and light-weight fixing device of fixing-belt type suitable for use in a compact image forming apparatus, which has a reduced number of components and a low heat capacity and can be heated promptly to an operating temperature proper for a fixing process.

4. Other objects of the invention will be apparent from the following detailed description of the invention with reference to the accompanying drawings.

BRIEF DESCRIPTION OF THE DRAWINGS

FIGS. 7(*a*), 7(*b*), and 7(*c*) are cross-sectional views each illustrating a belt-type fixing device according to a third embodiment of the present invention;

DETAILED DESCRIPTION OF THE PREFERRED EMBODIMENTS

First Embodiment

Figure 1:
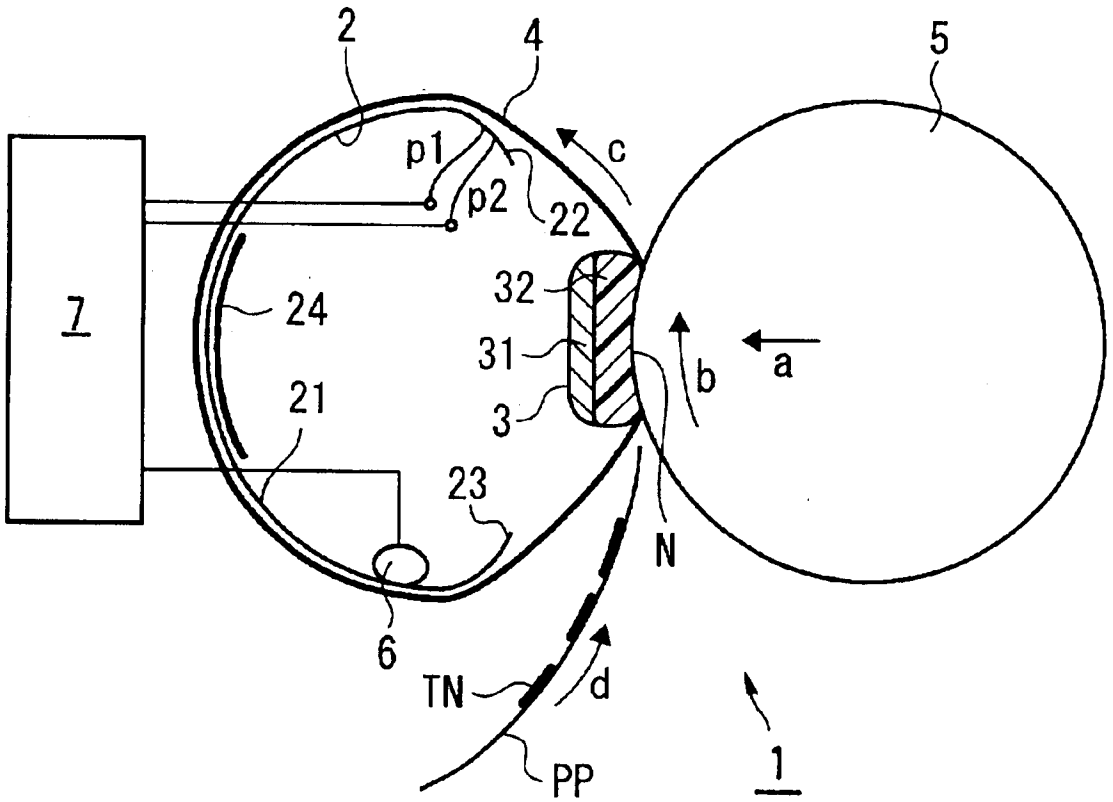
FIG. 1 is a cross-sectional view illustrating a structure of a belt-type fixing device according to a first embodiment of the present invention.

FIG. 1 is a cross-sectional view of a belt-type fixing device according to a first embodiment of the present invention. The belt-type fixing device 1 comprises: a heating plate 2; a pressing pad 3; a fixing belt 4; a pressing roller 5; a temperature sensing unit 6; and a control unit 7.

The fixing belt 4 is entrained about the pressing pad 3 and the heating plate 2 in a properly tensioned condition. The pressing pad 3 is composed of an elastic member 32 such as a heat resistant sponge fixed onto a rigid support member 31. A biasing force for pressing the fixing belt 4 against the pressing pad 3, as indicated by the arrow a, has been imparted to the pressing roller 5. The biasing force deforms the elastic member 32 and the fixing belt 4 into configurations conformal to the circular cross-sectional configuration of the pressing roller 5 so that a nip portion N is formed.

The heating plate 2 comprises: a cylindrical surface portion 21 having a nearly circular configuration; inwardly curved guide-in and guide-out portions 22 and 23 each extending continuously from the cylindrical surface portion 21. The guide-in and guide-out portions 22 and 23 guide the fixing belt 4 such that it smoothly comes in and goes out of contact therewith and prevent the edge portions of the heating plate 2 from damaging the fixing belt 4. The cylindrical surface portion 21 has a large contact area with the fixing belt 4 and conducts a majority of heat from the heating plate 2 through contact.

If the pressing roller 5 is driven to rotate in the direction indicated by the arrow b, the fixing belt 4 revolves in the direction indicated by the arrow c in association with the rotation of the pressing roller 5. A recording sheet PP with an unfixed toner image TN adhered thereto is introduced from the direction d indicated by the arrow d into the space between the pressing roller 5 and the fixing belt 4 so that heat and pressure are given to the recording sheet PP at the nip portion N. The heat and pressure fuse a toner so that it is secured, i.e., fixed to the recording sheet PP. The heat has been given by the cylindrical surface portion 21 of the heating plate 2 to the fixing belt 4 and transmitted to the nip portion N by the revolution of the fixing belt 4.

Figure 2:
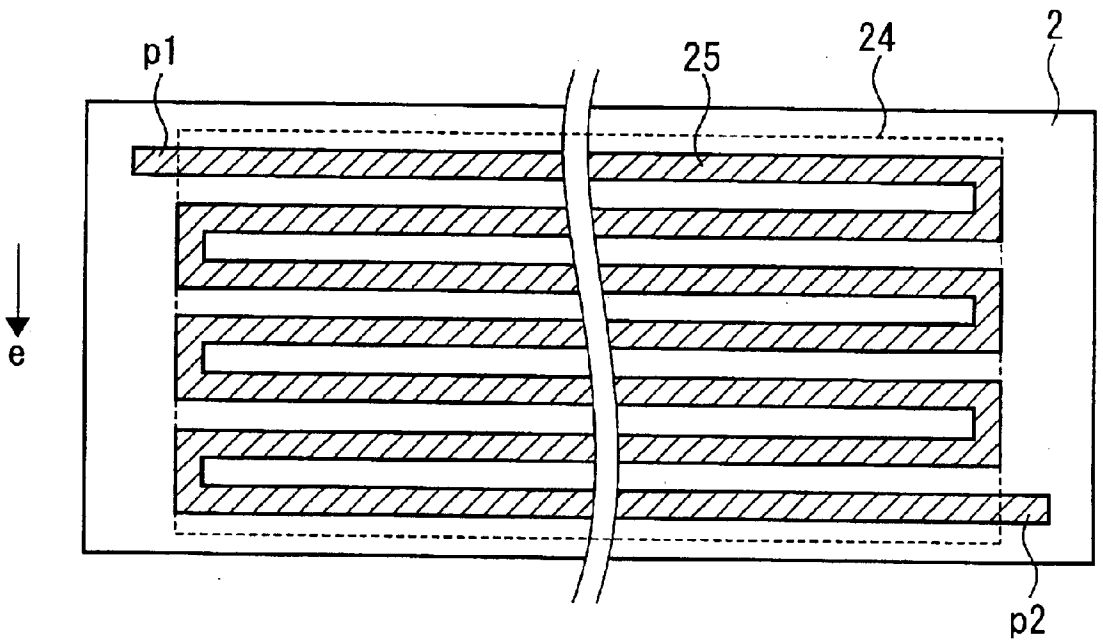
FIG. 2 is a development view of a resistance heat generator according to the first embodiment.

A sheet-like resistance heat generating member 24 for generating heat with power from the outside is provided on the back side of the cylindrical surface portion 21. FIG. 2 is a development view of the resistance heat generating member 24. As shown in FIG. 2, a resistance heat generator 25 is composed of a thin metal plate insulated from the cylindrical surface portion 21, which is bent several times or several tens of times in directions orthogonal to the direction of movement of the fixing belt 4 indicated by the arrow e. The application of a voltage to the both ends p1 and p2 of the resistance heat generator 25 causes resistance heating.

The resistance heat generator 25 is bent in the directions orthogonal to the arrow e for the prevention of uneven heat generation over the entire width of the fixing belt. Since the essence of the resistance heat generator 25 lies in even heat generation over a large surface and in efficient heat transmission to the cylindrical surface portion 21, the material of the resistance heat generator 25 is not limited particularly to the metal plate. The resistance heat generator 25 may also be composed of a foil or coating.

The heating plate 2 composed of such a thin plate member allows a significant reduction in heat capacity so that the temperature raising performance after the application of power subsequent to a power stop is improved. Since it is sufficient to turn on the heating plate 2 only when necessary, it exerts a large energy saving effect. Moreover, the heating plate 2 allows the fixing device to be reduced in size and weight since the heating plate 2 is freer from structural constraint added to heating means of radiation heating type, such as a halogen heater, which should be surrounded by an object to be heated. The energy saving effect of the heating plate 2 is also large in terms of transmitting heat to the fixing belt 4 by contact with the cylindrical surface portion 21 and thereby allowing efficient and highly responsive heat transmission.

Since the elastic member 32, such as a sponge, of the pressing pad 3 is low in each of heat capacity and heat conductivity, the amount of lost heat that has been transmitted to the nip portion N and dissipated into the elastic member 32 can be reduced so that heat from the fixing belt 4 is transmitted efficiently to the toner image TN.

The temperature sensing unit 6 is a sensor mounted on the heating plate 2 to measure the temperature thereof, such as a thermistor, which is preferably mounted downstream in the direction of movement of the fixing belt 4. Since the temperature of the heating plate 2 eventually corresponds to the temperature of the fixing belt 4, it follows therefore that the temperature sensing unit 6 senses the temperature of the fixing belt 4. The temperature sensing unit 6 is connected to the control unit 7 which controls power supplied to the heating plate 2 in accordance with the sensed temperature. The power control may be effected by any power control method, though it can be effected by thyristor control or the like.

Second Embodiment

Figure 3:
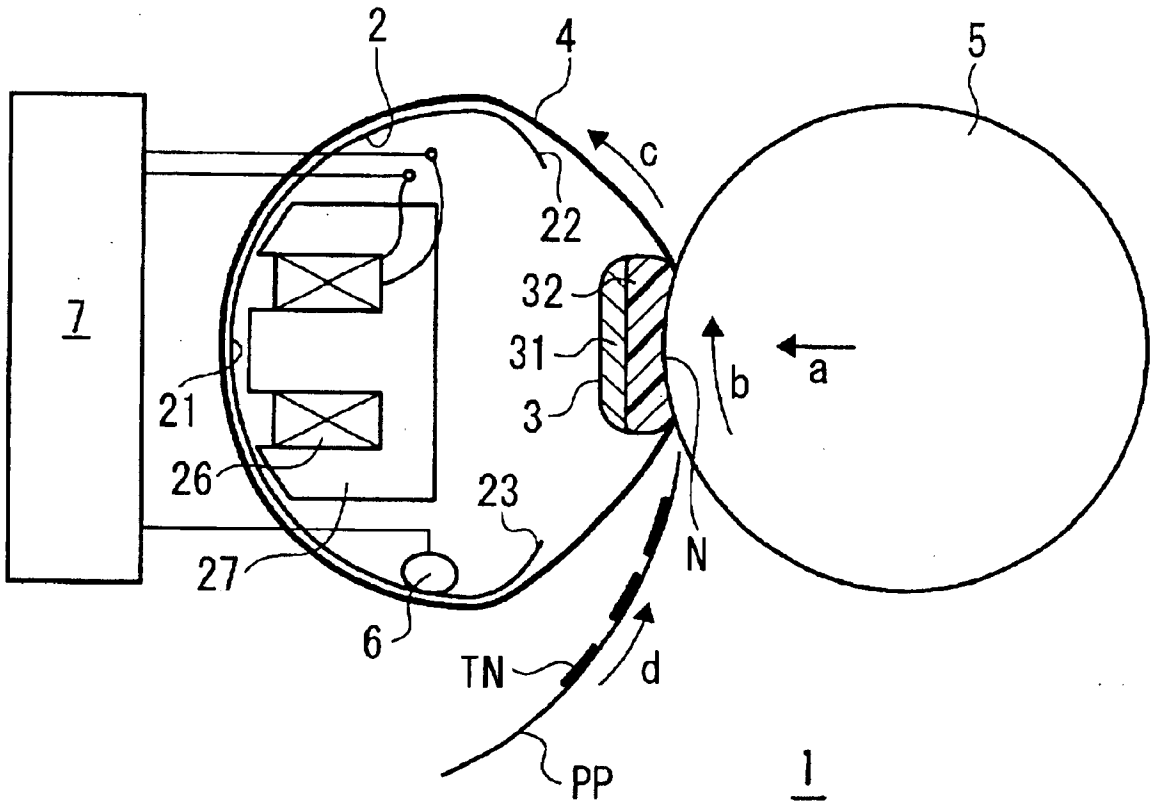
FIG. 3 is a cross-sectional view of a belt-type fixing device according to a second embodiment of the present invention.

FIG. 3 is a cross-sectional view of a belt-type fixing device 1 according to a second embodiment of the present invention. The belt-type fixing device 1 comprises: a heating plate 2, a pressing pad 3, a fixing belt 4, a pressing roller 5, a temperature sensing unit 6; and a control unit 7, similarly to the first embodiment. The second embodiment is different from the first embodiment in that the heating plate 2 is induction heated by an electromagnetic induction coil 26. Accordingly, the heating plate 2 is composed of a metal material, such as iron or stainless steel, which can be induction heated. It is to be noted that the heating plate 2 is not provided with the resistance heat generator 25. The description of the components common to the first embodiment is omitted by retaining the same reference numerals.

The electromagnetic induction coil 26 is wound around the center iron core of an E-shaped core 27 to have an open end located in proximity to the cylindrical surface portion 21. By allowing an alternating current on the order of several tens of K hertz in the electromagnetic induction coil 26, an eddy current is generated in the cylindrical surface portion 21, which generates Joule heat. The control unit 7 controls the amplitude of an alternating voltage based on the temperature sensed by the temperature sensing unit 6, thereby controlling a temperature to which the cylindrical surface portion 21 is heated in the same manner as in the first embodiment.

Figure 4:
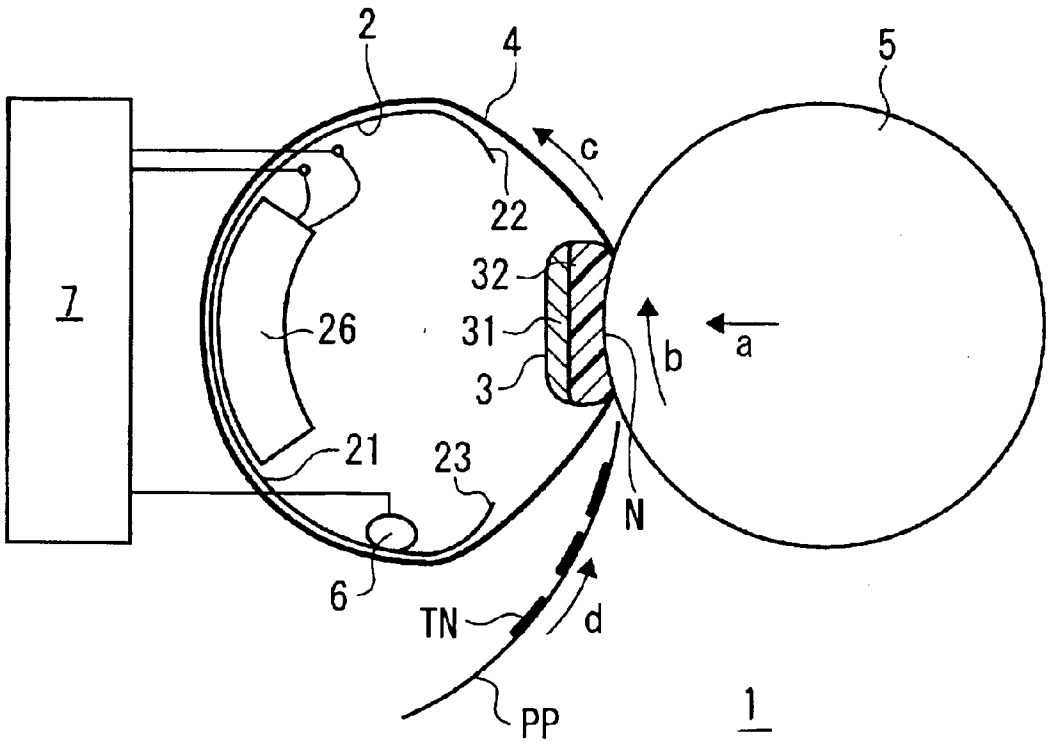
FIG. 4 is a cross-sectional view of alternative 1 of the second embodiment.

FIG. 4 shows alternative 1 of the second embodiment. In alternative 2, the E-shaped core 27 is not provided so that the electromagnetic induction coil 26 directly performs induction heating without inducing a magnetic field via the E-shaped core 27. The mode offers the advantage of a lighter-weight and simpler structure.

Figure 5:
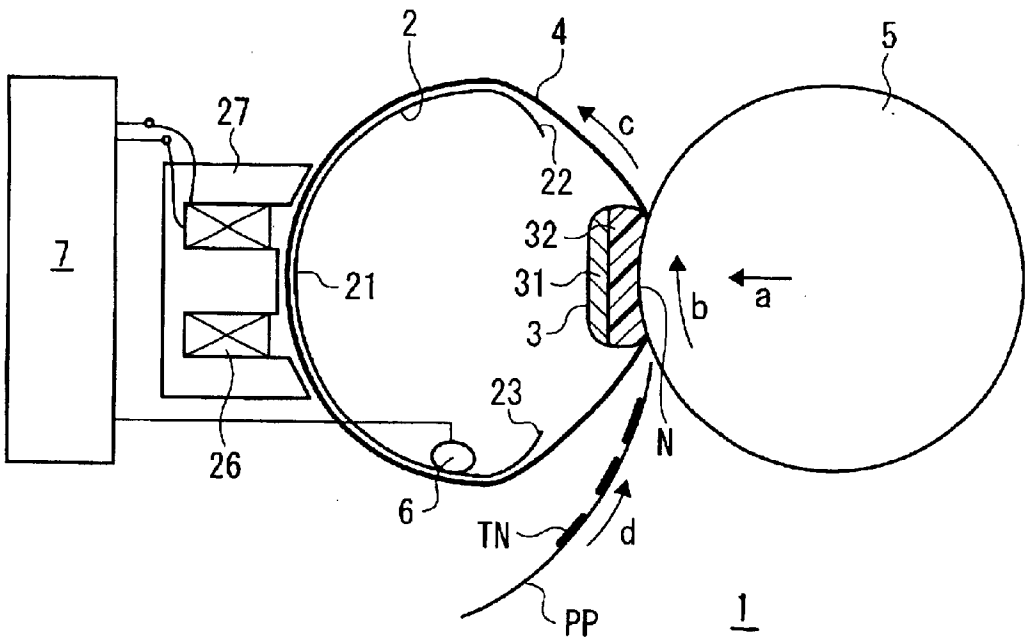
FIG. 5 is a cross-sectional view of alternative 2 of the second embodiment.

FIG. 5 shows alternative 2 of the second embodiment. In alternative 2, the electromagnetic induction coil 26 and the E-shaped core 27 according to the second embodiment are provided external to the fixing belt 4 so that the heating plate 2 is heated by electromagnetic induction through the fixing belt 4. Since it is unnecessary to accommodate the electromagnetic induction coil 26 and the E-shaped core 27 in the limited space inside the fixing belt 4 and heat generated by the electromagnetic induction coil 26 (the coil itself generates heat) is readily dissipated, design is performed more easily.

Figure 6:
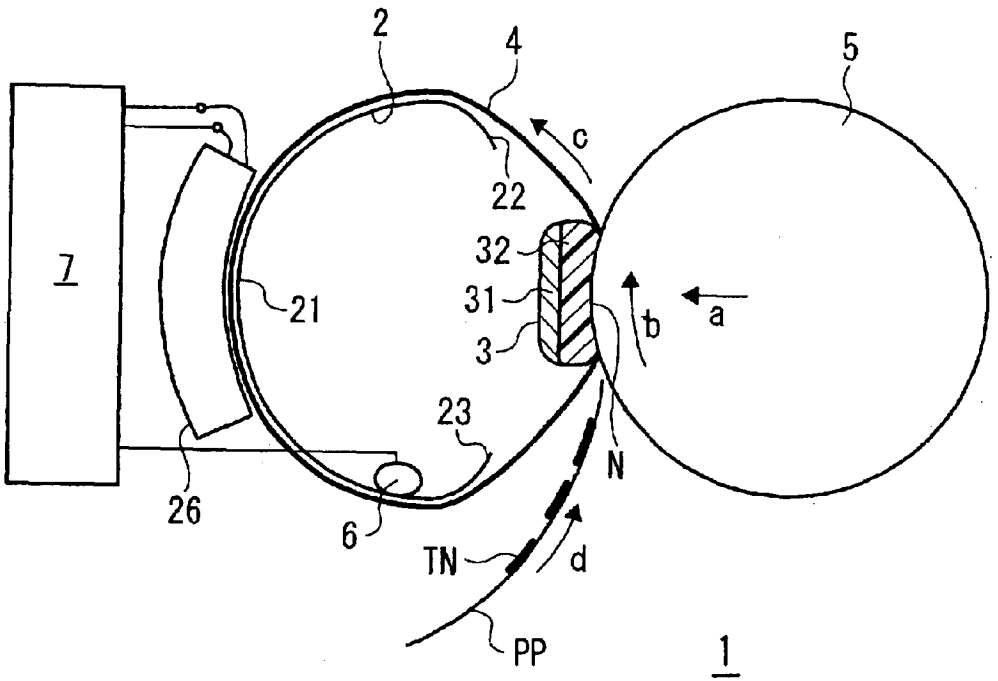
FIG. 6 is a cross-sectional view of alternative 3 of the second embodiment.

FIG. 6 shows alternative 3 of the second embodiment. In alternative 3, the E-shaped core 27 is not provided so that the electromagnetic induction coil 26 directly performs induction heating without inducing a magnetic field via the E-shaped core 27 in the same manner as in alternative 1. The mode offers the advantage of a lighter-weight and simpler structure also in the same manner as in alternative 1. Moreover, since it is unnecessary to accommodate the electromagnetic induction coil 26 and the E-shaped core 27 in the limited space inside the fixing belt 4 and heat generated by the electromagnetic induction coil 26 (the coil itself generates heat) is readily dissipated, design is performed more easily, which is the same as in alternative 2.

Electromagnetic induction heating has the advantage of extremely efficient heating since it can directly heat the object to be heated without depending on heat transmission. Moreover, electromagnetic induction heating improves the temperature raising performance since the heat capacity of the heating plate 2 can be reduced significantly in the same manner as in the first embodiment, exerts a large energy saving effect since it is sufficient to turn on the heating plate 2 only when necessary, reduces the size and weight of the fixing device since the heating plate 2 is more free from structural constraint as added to the halogen heater, and allows efficient and highly responsive heat transmission since heat is transmitted to the fixing belt 4 by contact with the cylindrical surface portion 21, thereby achieving a large energy saving effect.

Since the elastic member 32, such as the sponge of the pressing pad 3, has a low heat capacity and a low heat conductivity, the amount of lost heat that has dissipated to the elastic member 32 can be reduced so that heat from the fixing belt 4 is transmitted efficiently to the toner image TN in the same manner as in the first embodiment.

In each of the aforementioned belt-type fixing devices according the first and second embodiments, the heating plate may be disposed appropriately as will be shown later in the description of a belt-type fixing device according to a third embodiment of the present invention. That is, the heating plate may be supported rotatably around a support shaft parallel to the driving shaft, which is not shown, of the pressing roller and the support shaft may be positioned appropriately to be higher in level than the centroid of the heating plate and external to the centroid.

The heating plate described above may be constructed as will be shown later in the description of the belt-type fixing device according to the third embodiment. That is, the heating plate may be composed of at least a semi-cylindrical plate base made of a heat conductive material and a heat generator disposed on the surface of the plate base opposite to the surface thereof in contact relation with the fixing belt.

The heating plate may be held appropriately by a holding member disposed to cover the heat generator at a distance therefrom.

Third Embodiment

Figure 8:
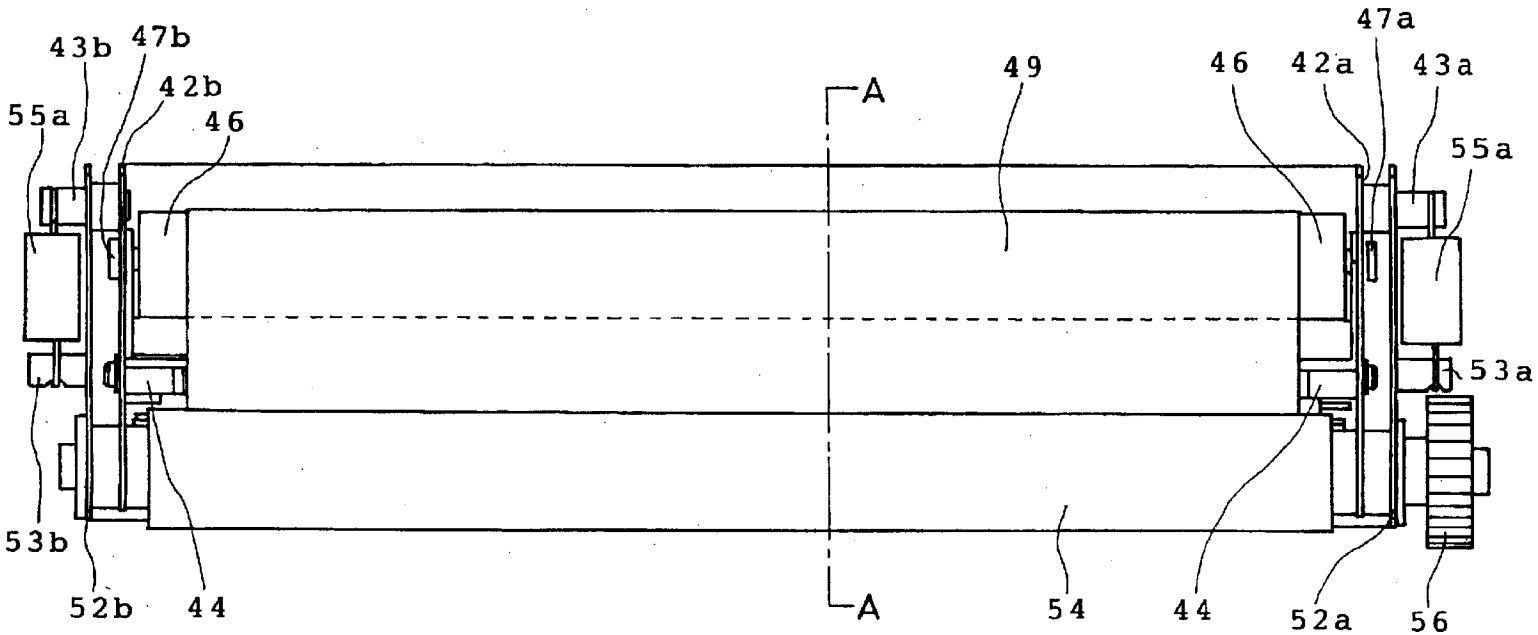
FIG. 8 is a front view of the belt-type fixing device shown in each of FIGS. 7(*a*), 7(*b*), and 7(*c*)
Figure 9:
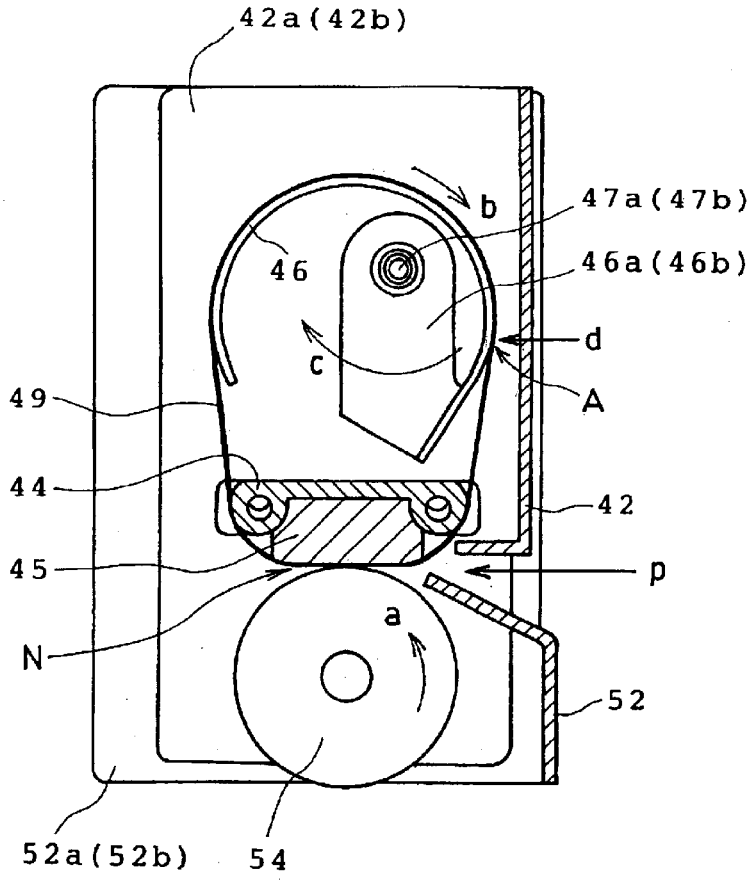
FIG. 9 is a cross-sectional view taken along the line A—A of the belt-type fixing device shown in FIG. 8.

The third embodiment of the present invention will be described. FIGS. 7(*a*) to 7(*c*) are views each illustrating a structure of a fixing device according to the third embodiment, of which FIG. 7(*a*) is a perspective view of a structure of a fixing belt assembly, FIG. 7(*b*) is a perspective view of a pressing roller assembly, and FIG. 7(*c*) is a perspective view of the fixing device completed by mounting the pressing roller assembly on the fixing belt assembly. FIG. 8 is a front view of the fixing device shown in FIG. 7. FIG. 9 is a cross-sectional view taken along the line A—A of the fixing device shown in FIG. 8.

A description will be given herein below with reference to FIGS. 7(*a*) to 7(*c*), FIG. 8, and FIG. 9. The fixing device 40 is composed of the fixing belt assembly 41 and the pressing roller assembly 51. The fixing belt assembly 41 is provided with a heating plate 46 composing a heater and a fixing belt 49 composing a fixing rotator. The pressing roller assembly 51 is provided with a pressing roller 54 composing a pressing rotator to be driven by a driving mechanism not shown.

The frame 42 of the fixing belt assembly 41 has brackets 42*a* and 42*b* provided at the both left and right ends thereof. Pins 43*a* and 43*b* are provided outwardly of the brackets 42*a* and 42*b* in inserted relation thereto. A guide 44 is disposed in fixed relation between the brackets 42*a* and 42*b*. A pressing pad 45 is attached to the lower surface of the guide 44.

As is obvious from the cross-sectional view shown in FIG. 9, the heating plate 46 is a semi-cylindrical heater composed of a material with a high heat conductivity, e.g., a base made of copper, aluminum, or the like to have an arcuate cross section. The heating plate 46 is composed of a well-known heat generating resistor disposed on the inner surface of the semi-cylindrical configuration.

The heating plate 46 has arms 46*a* and 46*b* formed on the both ends in the axial direction of the semi-cylindrical configuration thereof. The arms 46*a* and 46*b* are provided with respective support shafts 47*a* and 47*b* as heater support shafts. On the other hand, the brackets 42*a* and 42*b* are provided with respective shaft receiving holes 48*a* and 48*b* into which the support shafts 47*a* and 47*b* as the heater support shafts are to be fitted such that the heating plate 46 is held rotatably. It is to be noted that the heating plate 46 does not rotate, which is different from a conventional heating roller.

It is assumed that the support shafts 47*a* and 47*b* of the heating plate 46 are positioned higher in level than the centroid of the heating plate 46 and external to the centroid, i.e., positioned eccentrically external to a vertical plane passing through the centroid. A detailed description will be given later to the effect of a structure in which the support shafts 47*a* and 47*b* are positioned eccentrically.

Although the present embodiment has been described on the assumption that the arms are provided with the support shafts and the brackets are provided with the shaft receiving holes, it is also possible to provide the arms with the shaft receiving holes and provide the brackets with the support shafts.

The fixing belt 49 is a loop-like endless belt entrained in spanning relation between the heating plate 46 and the guide 44 having the pressing pad 45 composing the support member attached thereto. As the fixing belt 49, a belt high in heat resistance and having a mold release layer formed on the surface thereof, such as a belt composed of a nickel thin plate having a surface thereof covered with a silicon rubber layer or a belt composed of a thin plate of a polyimide resin having a surface thereof covered with a PFA layer, is used.

The guide 44 is composed of a material high in heat resistance such as a PPS resin or a phenol resin. The pressing pad 45 is composed of a pad main body made of a material high in heat resistance and low in heat conductivity and having a surface thereof covered with a material low in abrasion resistance, such as a pad composed of a silicon sponge having a surface thereof covered with a PFA layer.

The frame 52 of the pressing roller assembly 51 has brackets 52*a* and 52*b* provided on the both left and right ends thereof and the pressing roller 54 is rotatably supported thereby. In addition, a drive gear 56 engaged with a driving mechanism not shown is mounted on the shaft of the pressing roller 54.

Engaging claws 53*a* and 53*b* are formed outwardly of the brackets 52*a* and 52*b* of the pressing roller assembly 51, while pins 43*a* and 43*b* are provided outwardly of the brackets 42*a* and 42*b* of the fixing belt assembly 41, so that fixing springs 55*a* and 55*b* are provided in spanning relation between the pin 43*a* and the engaging claw 53*a* and between the pin 43*b* and the engaging claw 53*b*, respectively.

The pressing roller 54 is composed of a material high in resistance such as one composed of a silicon sponge covering a cored bar and having a surface thereof covered with a PFA layer or one composed of a silicon rubber covering a cored bar and having a surface thereof covered with a PFA layer.

A description will be given to the assembly of the foregoing structure. First, the fixing belt 49 configured as the loop-like endless belt is entrained in spanning relation between the heating plate 46 and the guide 44 including the pressing pad 45. The heating plate 46 and the pressing roller 54 are disposed such that the rotation shaft of the pressing roller 54 is parallel to the axial direction of the semi-cylindrical configuration of the heating plate 46. The fixing springs 55*a* and 55*b* are provided in spanning relation between the pin 43*a* and the engaging claw 53*a* and between the pin 43*b* and the engaging claw 53*b*, respectively.

Since the fixing belt assembly 41 and the pressing roller assembly 51 are biased in the direction in which they approach each other by the pulling action of the fixing springs 55*a* and 55*b*, the pressing pad 45 of the fixing belt assembly 41 and the pressing roller 54 are pressed against each other with the fixing belt 49 interposed therebetween so that a fixing nip portion N is formed at a surface at which the pressing pad 45 and the pressing roller 54 are pressed against each other.

Figure 10A:
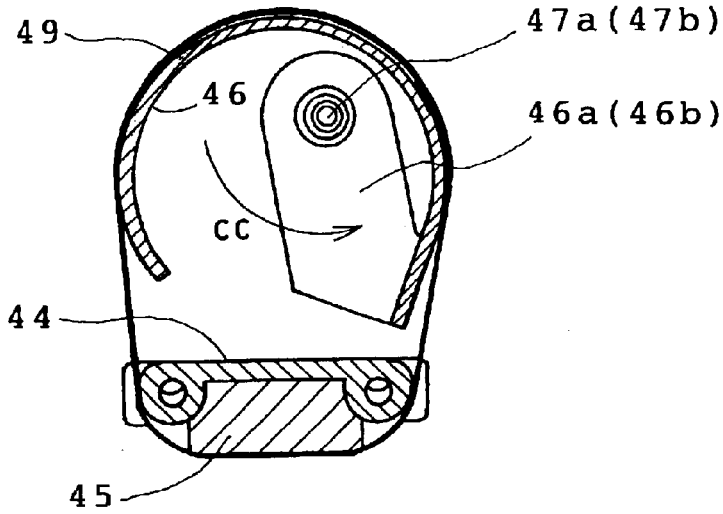
FIGS. 10(*a*) and 10(*b*) are cross-sectional views each illustrating a positional relationship between a heating plate and a fixing belt in the belt-type fixing device.
Figure 10B:
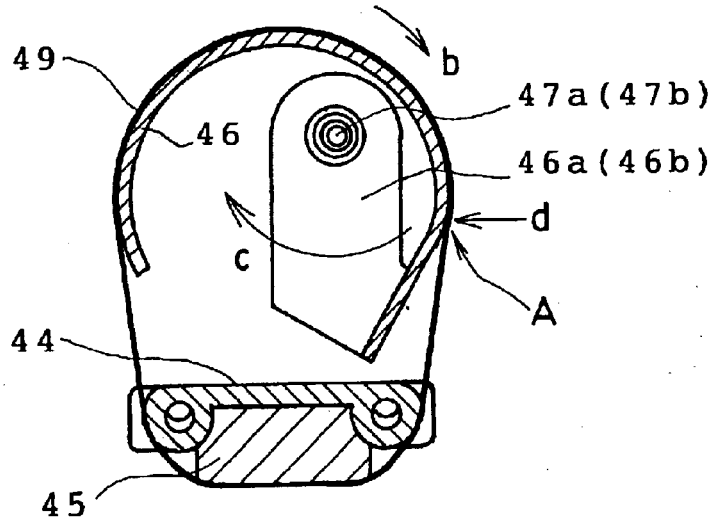

A description will be given next to the operation of the fixing device described above. FIGS. 10(*a*) and 10(*b*) are cross-sectional views each illustrating a positional relationship between the heating plate 46 and the fixing belt 49 in the fixing device, of which FIG. 10(*a*) shows the fixing device in a non-operating state and FIG. 10(*b*) shows the fixing device in an operable state.

When the fixing device is in the non-operating state, the pressing roller 54 does not rotate so that the fixing belt 49 pressed against the pressing roller 54 is also halted. In this state, the heating plate 46 rotates counterclockwise (in the direction indicated by the arrow cc) around the support shafts 47*a* and 47*b* under the influence of gravity since the heating plate 46 has the support shafts 47*a* and 47*b* of the arms 46*a* and 46*b* thereof positioned higher in level than the centroid of the heating plate 46 and external to the centroid, as stated previously.

Consequently, the upper surface of the heating plate 46 comes away from the fixing belt 49 and the heating plate 46 moves downward under the influence of gravity so that the tension given to the fixing belt 49 by the heating plate 46 is removed (see FIG. 10(*a*)).

When the fixing device is in an operating state, the pressing roller 54 rotates in the direction indicated by the arrow a and the fixing belt 49 pressed against the pressing roller 54 to be driven thereby also moves in the direction indicated by the arrow b. In this state, the movement of the fixing belt 49 in the direction indicated by the arrow b exerts a force pressing the heating plate 46 in the direction indicated by the arrow d on the vicinity of the portion A of the fixing belt 49 which first comes away from the heating plate 46. Consequently, the heating plate 46 rotates clockwise (in the direction indicated by the arrow c) around the support shafts 47*a* and 47*b* against the influence of gravity to press the fixing belt 49 upward, thereby bringing the fixing belt 49 into close contact with the heating plate 46 (see FIG. 10(*b*)).

As the fixing belt 49 in contact with the heating plate 46 moves continuously in the direction indicated by the arrow b, the pressing plate 46 rotates clockwise (in the direction indicated by the arrow c) to constantly press the fixing belt 49 upward so that the fixing belt 49 in close contact with the pressing plate 46 moves in the direction indicated by the arrow b in a properly tensioned condition.

The sliding movement of the fixing belt 49 in close contact with the heating plate 46 allows efficient transmission of heat generated in the heating plate 46 to the fixing belt 49.

When the pressing roller 54 stops rotation, the state shown in FIG. 10(*a*) is restored so that the heating plate 46 moves downward under the influence of gravity and the fixing belt 49 slackens out of tension. This not only elongates the lifespan of the fixing belt 49 but also renders the fixing belt 49 less likely to recover a curved or like shape which is remembered when the fixing belt 49 is allowed to stand in a tensioned condition for a long time.

The fixing operation performed by the belt-type fixing device will be described briefly with reference to FIG. 9. It is assumed first that the heating plate 46 has been energized by an electric resistor for heating under the control of a control unit not shown and heated to a specified fixing temperature. The pressing roller 54 rotates in the direction indicated by the arrow a and the fixing belt 49 pressed against the pressing roller 54 to be driven thereby also moves in the direction indicated by the arrow b. At that time, the fixing belt 49 is heated to the specified fixing temperature while it is moving in the direction indicated by the arrow a in sliding contact with the non-rotating heating plate 46.

A recording medium P having a toner image formed on the surface thereof is conveyed out of the imaging mechanism of an image forming apparatus not shown. When the recording medium P is caused to pass through the fixing nip portion N at which the pressing roller 54 and the fixing belt 49 are pressed against each other, the toner image on the recording medium P comes in contact with the fixing belt 49 heated to the specified fixing temperature to be heated, while it is pressed by the pressing roller 54, whereby the fixing process for the toner image on the recording medium P is completed.

Fourth Embodiment

A description will be given next to a belt-type fixing device according to a fourth embodiment of the present invention. The foregoing third embodiment has described that, when the fixing device is in the non-operating state, the fixing belt 49 moves downward under the influence of gravity and the tension given to the fixing belt 49 is removed. In the fourth embodiment, a fixing belt 49 is kept away from a heating plate 46 by using a spring, without depending on gravity, when the fixing device is in the non-operating state so that the tension is removed.

Figure 11:
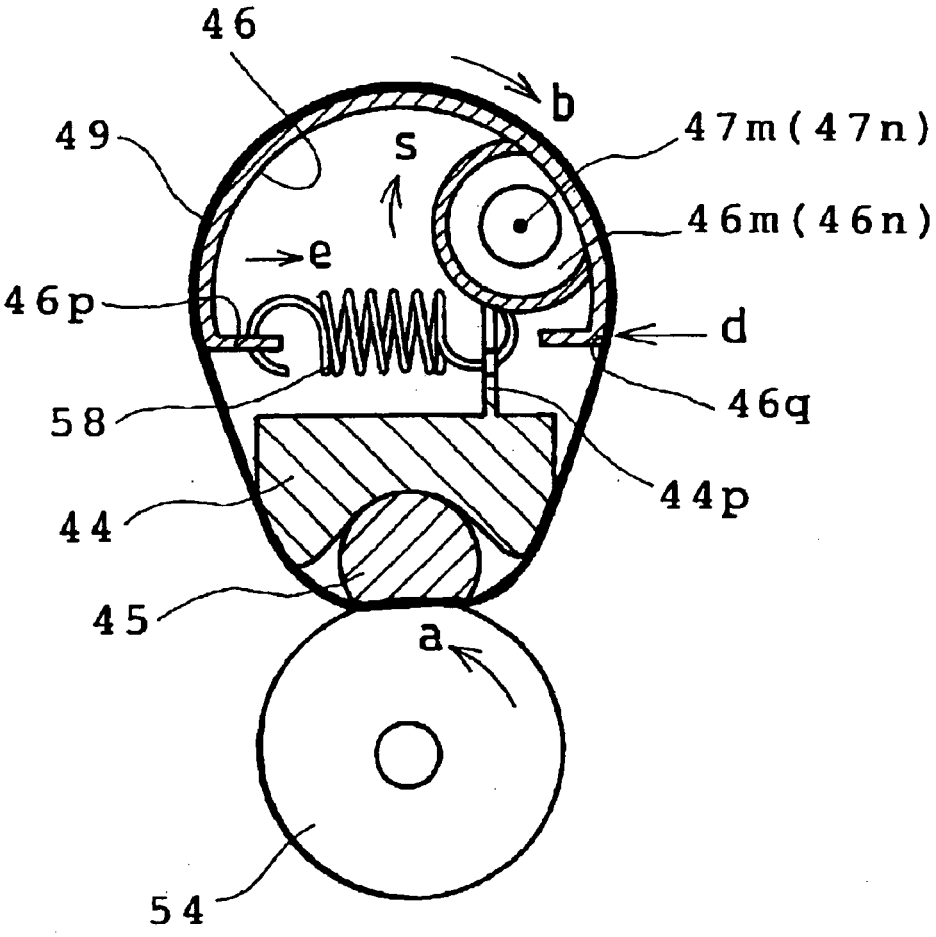
FIG. 11 is a cross-sectional view illustrating a structure of a belt-type fixing device according to a fourth embodiment of the present invention.

FIG. 11 is a cross-sectional view illustrating a structure of the belt-type fixing device according to the fourth embodiment. The description of the same components as used in the third embodiment will be omitted by retaining the same reference numerals.

In FIG. 11, the loop-like fixing belt 49 composing a fixing rotator is entrained in spanning relation between a semi-cylindrical heating plate 46 composing a heater and a guide 44 having a pressing pad 45 composing a support member attached thereto. A pressing roller 54 composing a pressing rotator is positioned parallel to the axial direction of the cylindrical configuration of the heating plate 46.

The structure in which a fixing belt assembly including the fixing belt and a pressing roller assembly including the pressing roller are biased in the direction in which they approach each other by the pulling action of fixing springs, the fixing belt of the fixing belt assembly and the pressing roller are pressed against each other, and a fixing nip portion N is formed at a surface at which the fixing belt and the pressing roller are pressed against each other is the same as in the third embodiment, though it is not depicted in FIG. 11.

A guide 44 having the pressing pad 45 mounted thereon is provided with an engaging member 44*p*. The heating plate 46 has one end 46*p* engaged in one end of the spring 58 and the other end of the spring 58 is engaged in the engaging member 44*p* so that the one end 46*p* of the semi-cylindrical heating plate 46 is pulled in the direction indicated by the arrow e, i.e., in the direction away from the fixing belt 49.

The heating plate 46 has holding portions 46*m* and 46*n* formed on the both ends in the axial direction of the semi-cylindrical configuration thereof and supported rotatably by support shafts 47*m* and 47*n*. Since the support shafts 47*m* and 47*n* are positioned internal to the other end 46*q* of the heating plate 46, the heating plate 46 receives a clockwise rotating force around the support shafts 47*m* and 47*n* if a force in the direction indicated by the arrow d is applied to the end 46*q*.

When the fixing device is in the non-operating state in the foregoing structure, the pressing roller 54 does not rotate so that the fixing belt 49 pressed against the pressing roller 54 to be driven thereby is also halted. In this state, the one end 46*p* of the heating plate 46 is pulled in the direction indicated by the arrow e by the spring 58, as described above, so that the upper surface of the heating plate 46 is kept away from the fixing belt 49.

When the fixing device is in an operating state, the pressing roller 54 rotates in the direction indicated by the arrow a and the fixing belt 49 pressed against the pressing roller 54 to be driven thereby also moves in the direction indicated by the arrow b. The movement of the fixing belt 49 in the direction indicated by the arrow b exerts a force moving the heating plate 46 in the direction indicated by the arrow d on the vicinity of the portion of the fixing belt 49 which first comes away from the heating plate 46, i.e., the other end 46*q* of the heating plate 46. Consequently, the heating plate 46 rotates clockwise (in the direction indicated by the arrow s) around the support shafts 47*m* and 47*n* against the biasing force of the spring 58 to press the fixing belt 49 upward so that the arcuate surface of the heating plate 46 comes into close contact with the fixing belt 49.

When the arcuate surface of the heating plate 46 has come into close contact with the fixing belt 49, the heating plate 46 receives such a force as to rotate clockwise (in the direction indicated by the arrow s) around the support shafts 47*m* and 47*n* from the frictional force therebetween so that the heating plate 46 and the fixing belt 49 are brought into closer contact. While the fixing belt 49 continues movement, the close contact state between the heating plate 46 and the fixing belt 49 is maintained. The sliding movement of the fixing belt 49 in close contact with the heating plate 46 allows efficient transmission of heat generated in the heating plate 46 to the fixing belt 49.

Since the structure does not use gravity to keep the fixing belt 49 away from the surface of the heating plate 46 when the fixing device is in the non-operating state, it is unnecessary to consider the direction of gravity when the fixing device is installed in the image forming apparatus so that free installation is enabled.

Fifth Embodiment

Figure 12:
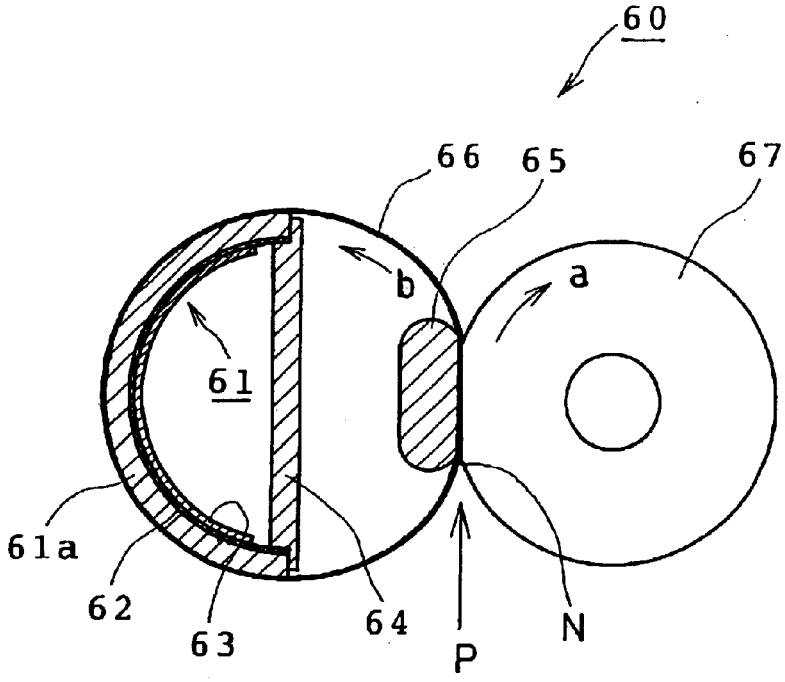
FIG. 12 is a first cross-sectional view illustrating a structure of a belt-type fixing device according to a fifth embodiment of the present invention.

A description will be given to a fifth embodiment of the present invention. FIG. 12 is a cross-sectional view illustrating a structure of a fixing device 60 according to the fifth embodiment. The fixing device 60 is composed of: a heating plate 61; a holding member 64 as a holder for holding the heating plate at a distance therefrom; a pressing pad 65 as a support member disposed on the opposite side of the heating plate 61 with the holding member 64 interposed therebetween; a fixing belt 66 as a fixing rotator entrained in spanning relation between the heating plate 61 and the pressing pad 65; and a pressing roller 67 as a pressing rotator disposed at a position opposed to the pressing pad 65 with the fixing belt 66 interposed therebetween.

Figure 13:
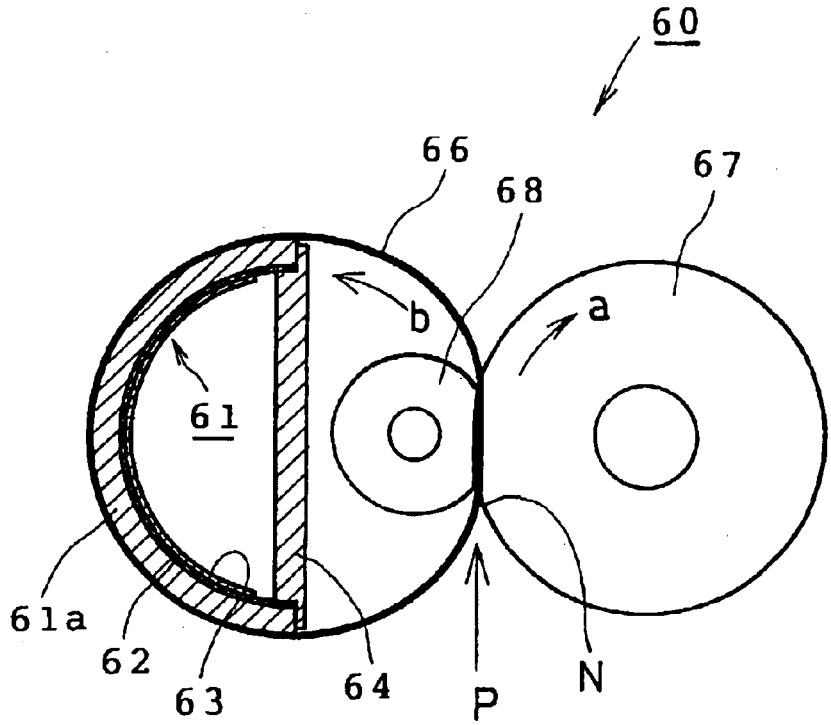
FIG. 13 is a second cross-sectional view illustrating the structure of the belt-type fixing device according to the fifth embodiment.

Alternatively, as shown in FIG. 13, it is also possible to dispose an opposing roller 68 as a support member in place of the pressing pad 65 as a support member, entrain the fixing belt 66 about the pressing plate 61 and the opposing roller 68, and dispose the pressing roller 67 at a position opposed to the opposing roller 68 with the fixing belt 66 interposed therebetween.

The heating plate 61 is constructed by attaching a heater 63 to a plate base 61*a* prepared by forming a heat conductive material, e.g., a plate material with a thickness of about 0.5 mm such as a metal plate made of copper, aluminum, or the like into a semi-cylindrical configuration (trough-like configuration) with an electric insulating layer 62 interposed therebetween. The attachment is performed by affixment or by any other appropriate means. The electric insulating layer 62 is constituted to extend outwardly from the peripheral end portion of the heater 63 by a specified dimension, e.g., by 2.0 mm or more when a power supply voltage is 100 V to 125 V and by 2.5 mm or more when the power supply voltage is 200 V to 240 V for the prevention of a short circuit between the peripheral end portion of the heat generator 63 and the plate base 61*a*.

As the electric insulating layer 62, a heat resistant synthetic resin film is used assumedly. For example, a polyimide ranging from, e.g., 10 to 30 $\mu$m may be used appropriately.

As the heat generator 63, a resistor obtained by dispersing metal powder in a heat resistant synthetic resin such as a resistor obtained by dispersing Nichrome powder, molybdenum powder, or the like in polyimide (PI) or a resistor composed of a metal foil such as a foil made of stainless steel ranging from, e.g., 20 to 30 $\mu$m or a foil made of another metal may be used. In addition to a power supply terminal, a temperature sensing element for sensing the temperature of the heat generator 63 is provided in the heat generator 63 in contact relation therewith, though they are not depicted in FIG. 12. The heat generator 63 is supplied with power via a control unit not shown so that temperature control is performed to maintain a specified fixing temperature.

Since the holding member 64 for holding the heating plate 61 has a plurality of examples, the structures thereof will be described later in detail. The holding member 64 is formed by molding a synthetic resin. As a synthetic resin material, a synthetic resin such as polyethylene terephthalate (PET), polyphenylene sulfide (PPS), polybutylene terephthalate (PBT), acrylonitrile-butadiene-styrene (ABS), a mixture of polybutylene terephthalate (PBT) and acrylonitrile-butadiene-styrene (ABS), polyamide-imide (PAI), or polyimide (PI) may be used or a fiber reinforced composite material obtained by mixing 50% or less of glass fiber in such a resin material may be used instead.

The pressing pad 65 is composed of a pad main body made of a material high in heat resistance and low in heat conductivity and having a surface thereof covered with a material low in abrasion resistance, such as a silicon sponge having a surface thereof covered with a PFA layer. Preferably, the pressing pad 65 is mounted on a proper holding member and then secured to the fixing device.

The fixing belt 66 is a loop-like endless belt entrained in spanning relation between the heating plate 61 and the pressing pad 65 or pressing roller 68. As the fixing belt 66, a belt composed of a silicon rubber layer coated on a nickel thin plate, a belt composed of a PFA layer coated on a thin plate made of a polyimide resin, or the like is used.

Each of the pressing roller 67 and the opposing pressing pad 65 or pressing roller 68 is composed of a material high in heat resistance such as one obtained by covering a cored bar made of aluminum or iron with a silicon sponge and covering the surface of the silicon sponge with a PFA layer or one obtained by covering a cored bar made of aluminum or iron with a silicon rubber and covering the surface of the silicon rubber with a PFA layer.

A fixing operation performed by the fixing device 60 will be described briefly. It is assumed that the heating plate 61 has been energized by the heat generator 63 under the control of a control unit not shown and heated to a specified fixing temperature. The pressing roller 67 rotates in the direction indicated by the arrow a and the fixing belt 66 pressed against the pressing roller 67 to be driven thereby also moves in the direction indicated by the arrow b. Heat is transmitted from the heating plate 61 to the fixing belt 66 while the fixing belt 66 is moving in sliding contact with the non-rotating heating plate 61 so that the fixing belt 66 is heated to a specified fixing temperature.

A recording medium P having a toner image formed on the surface thereof is conveyed out of the imaging mechanism of an image forming apparatus not shown. When the recording medium P is caused to pass through a fixing nip portion N at which the pressing roller 67 and the fixing belt 66 are pressed against each other, the toner image on the recording medium P is brought into contact with the fixing belt 66 heated to the specified temperature and heated, while it is pressed by the pressing roller 67, whereby the fixing process for the toner image on the recording medium P is completed.

A description will be given next to the holding structure for securing the heating plate 61 to the holding member 64.

The holding member 64 holds the heating plate 61 at a distance therefrom. The holding structure has a plurality of examples, which will be described in succession.

Figure 14A:
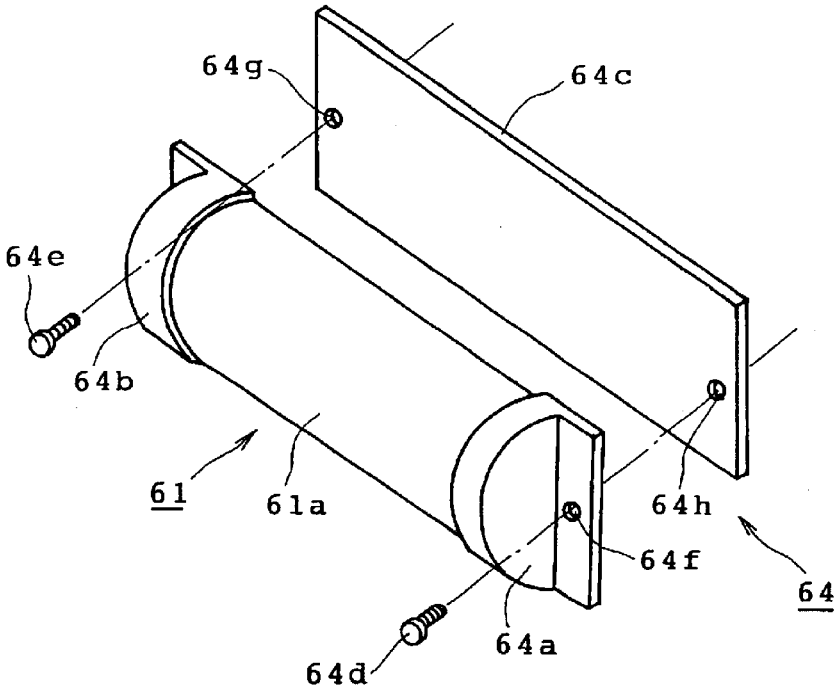
FIGS. 14(*a*) and 14(*b*) are views showing a first example of a holding structure for securing a heating plate to a holding member.
Figure 14B:
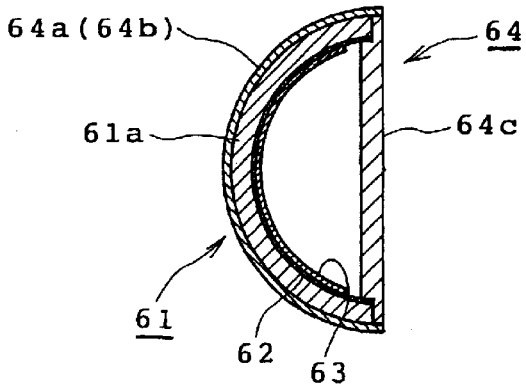

FIGS. 14(*a*) and 14(*b*) are views each showing a first example of the holding structure for securing the heating plate 61 to the holding member 64, of which FIG. 14(*a*) is a perspective view showing the outer appearance thereof and FIG. 14(*b*) is a cross-sectional view thereof.

The holding member 64 is composed of holders 64*a* and 64*b* formed in receiving portions each having a semi-cylindrical end face and a holding plate 64*c*. The both end portions in the longitudinal direction of the plate base 61*a* (in the axial direction of the semi-cylindrical configuration) are fitted into the semi-cylindrical receiving portions of the holders 64*a* and 64*b* and the holders 64*a* and 64*b* are secured to the holding plate 64*c* with screws. In the drawings, 64*f* denotes a screw hole provided in the holder, while 64*h* and 64*g* denote screw holes provided in the holding plate 64*c*.

In the foregoing structure, the semi-cylindrical heating plate 61 has only the end portions in the circumferential direction thereof in contact with the holding plate 64*c* and the end portions in the axial direction of the cylinder in contact with the semi-cylindrical receiving portions of the holders 64*a* and 64*b*, while spaces are formed between the heat generator 63 disposed on the inner surface of the heating plate 61 and the holders 64*a* and 64*b* and between the heat generator 63 and the holding plate 64*c*, so that the heat generator 63 is held in covered relation by the holding member 64 at a distance therefrom.

As a result, the inner surface of the heating plate 61 is closed so that heat radiation is suppressed. This enhances heat efficiency as well as safety.

Figure 15:
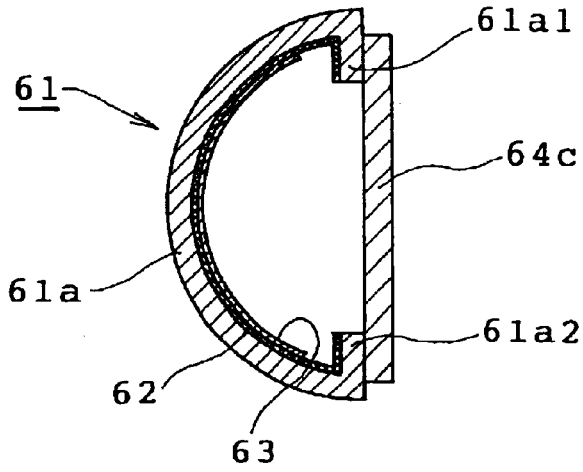
FIG. 15 is a view showing a second example of the holding structure for securing the heating plate to the holding member.

FIG. 15 is a cross-sectional view showing a second example of the holding structure for securing the heating plate 61 to the holding member 64.

The plate base 61*a* of the heating plate 61 has upper and lower end portions in the circumferential direction thereof bent in the radial direction of the semi-cylindrical configuration, thereby forming extended portions 61*a*1 and 61*a*2. The extended portions 61*a*1 and 61*a*2 are secured to the side surface of the holding plate 64*c*. For a safety reason, the both end portions in the longitudinal direction of the heating plate 61 (in the axial direction of the semi-cylindrical configuration) may be closed by appropriate means such as closing plates provided on the holding plate 64*c*. As the closing structure, e.g., the same structure as adopted in the first example shown in FIG. 14 may be adopted.

In the structure also, the semi-cylindrical heating plate 61 has only the end portions in the circumferential direction thereof in contact with the holding plate 64*c*, while a space is formed between the heat generator 63 disposed on the inner surface of the heating plate 61 and the holding plate 64*c*, so that the heater 63 is held in covered relation by the holding member 64 at a distance therefrom and heat radiation is suppressed thereby. This enhances heat efficiency as well as safety.

Figure 16:
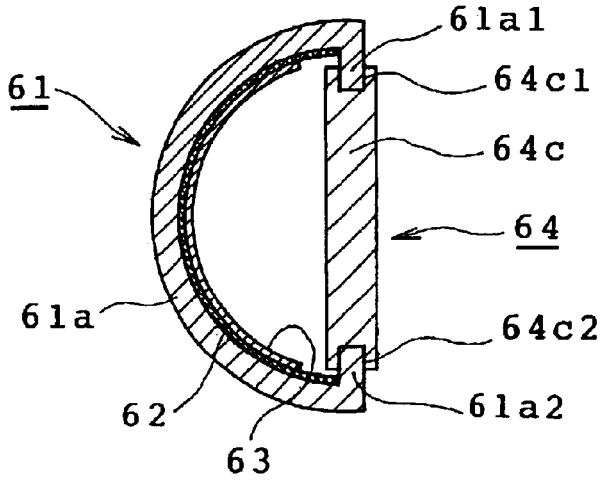
FIG. 16 is a view showing a third example of the holding structure for securing the heating plate to the holding member.

FIG. 16 is a cross-sectional view showing a third example of the holding structure for securing the heating plate 61 to the holding member 64.

The plate base 61*a* of the heating plate 61 has upstream and downstream end portions in the direction of movement of the fixing belt 66 entrained thereabout bent in the radial direction of the semi-cylindrical configuration thereof, thereby forming extended portions 61*a*1 and 61*a*2. The extended portions 61*a*1 and 61*a*2 are fitted in secured relation into grooves 64*c*1 and 64*c*2 provided in the upper and lower end faces of the holding plate 64*c*. In the structure, the plate base 61*a* can be fitted into the holding plate 64*c* by moving the plate base 61*a* toward the front or back of FIG. 16 so that the mounting operation is performed more easily.

For a safety reason, the both end portions in the longitudinal direction of the heating plate 11 (in the axial direction of the semi-cylindrical configuration) may be closed by appropriate means such as closing plates provided at the holding plate 64*c*. As the closing structure, e.g., the same structure as adopted in the first example shown in FIG. 14 may be adopted.

In the structure also, the semi-cylindrical heating plate 61 has only the end portions in the circumferential direction thereof in contact with the holding plate 64*c*, while a space is formed between the heat generator 63 disposed on the inner surface of the semi-cylindrical heating plate 61 and the holding plate 64*c*, so that the heat generator 63 is held in covered relation by the holding member 64 at a distance therefrom and heat radiation is suppressed. This enhances heat efficiency as well as safety.

Figure 17:
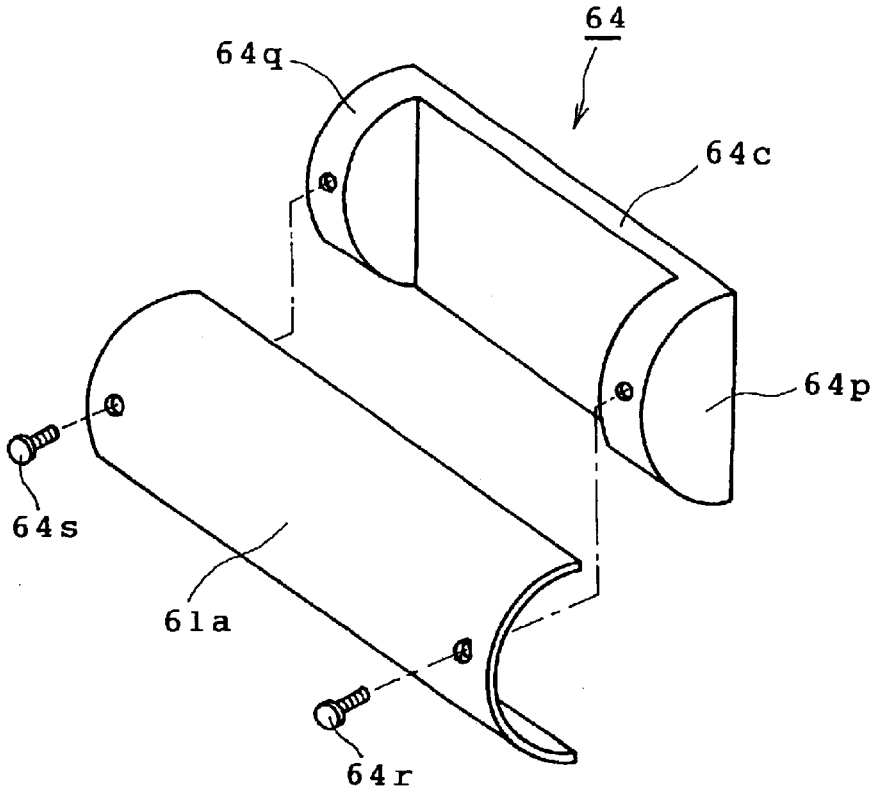
FIG. 17 is a view showing a fourth example of the holding structure for securing the heating plate to the holding member.

FIG. 17 is a cross-sectional view showing a fourth embodiment of the holding structure for securing the heating plate 61 to the holding member 64.

In the fourth example, the holding member 64 is composed of a holding plate 64*c* and semi-cylindrical holders 64*p* and 64*q* formed at the end portions in the longitudinal direction thereof (in the axial direction of the semi-cylindrical configuration). The end portions in the longitudinal direction of the heating plate 61 (in the axial direction of the semi-cylindrical configuration) are secured to the holders 64*p* and 64*q* with respective screws 64*r* and 64*s*.

In the structure also, the semi-cylindrical heating plate 61 has only the end portions in the circumferential direction thereof in contact with the holding plate 64*c* and the end portions in the axial direction of the cylinder in contact with the semi-cylindrical holders 64*p* and 64*q*, while spaces are formed between the heat generator 63 disposed on the inner surface of the heating plate 61 and the holding plate 64*c* and between the heat generator 63 and the holders 64*p* and 64*q*, so that the heat generator 63 is held in covered relation by the holding member 64 at a distance therefrom.

As a result, the inner surface of the heating plate 61 is closed so that heat radiation is suppressed. This enhances heat efficiency and safety.

Figure 18:
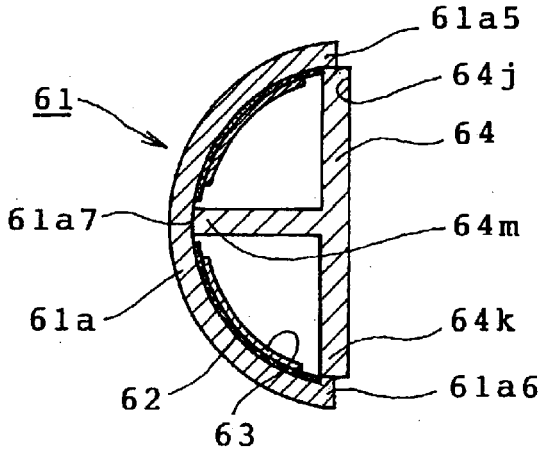
FIG. 18 is a view showing a fifth example of the holding structure for securing the heating plate to the holding member.

FIG. 18 is a cross-sectional view showing a fifth example of the holding structure for securing the heating plate 61 to the holding member 64.

In the fifth example, the holding member 64 is composed of holding portions 64*j* and 64*k* and a holding leg portion 64*m* to have a T-shaped cross-sectional configuration such that the plate base 61*a* of the semi-cylindrical heating plate 61 has one end portion 61*a*5 in the circumferential direction thereof held by the holding portion 64*j*, the other end portion 61*a*6 in the circumferential direction thereof held by the holding portion 64*k*, and a center portion 61*a*7 held by the holding leg portion 64*m*.

In the structure, an electric insulating layer 62 and the heat generator 63 disposed on the inner surface of the plate base 61*a* are halved so that the holding leg portion 64*m* of the holding member 64 is in direct contact with the plate base 61*a*.

Figure 19A:
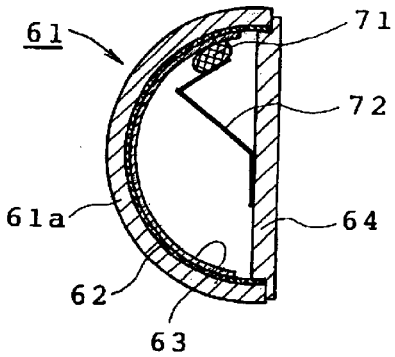
FIGS. 19(*a*) and 19(*b*) are cross-sectional views each showing a mounting structure for a temperature sensing element.
Figure 19B:
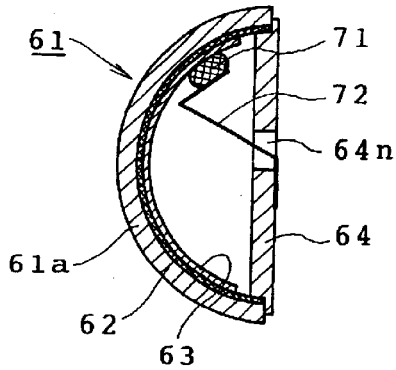

A description will be given next to a mounting structure for the temperature sensing element for sensing the temperature of the heat generator. FIG. 19(*a*) shows a first example of the mounting structure and FIG. 19(*b*) shows a second example of the mounting structure.

In the first example of the mounting structure shown in FIG. 19(*a*), a temperature sensing element 71 is adhered to the heat generator 63 and secured thereto by means of a sheet metal 72 extended from the holding member 64.

The second example of the mounting structure shown in FIG. 19(*b*) is similar to the first example of the mounting structure mentioned above except that a hole 64*n* is provided in the holding member 64 such that the temperature sensing element 71 having the sheet metal 72 attached thereto is inserted through the hole 64*n* in the space formed between the heating plate 61 and the holding member 64 and the temperature sensing element 71 is secured to the heat generator 63. The structure allows the temperature sensing element 71 to be inserted in the space through the whole 64*n* and attached to the heat generator 63 after the attachment of the heating plate 61 to the holding member 64. As the temperature sensing element 71, a thermistor may be used appropriately.

Figure 20:
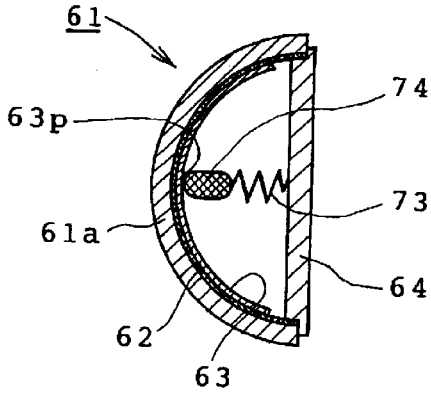
FIG. 20 is a cross-sectional view showing a structure for supplying power to a heat generator.

FIG. 20 is a cross-sectional view showing a structure for supplying power to the heat generator. The heat generator 63 has a contact terminal 63*p* for power supply formed at the end portion in the longitudinal direction thereof (i.e., at the end portion in the longitudinal direction (axial direction) of the semi-cylindrical heating plate 61 to which the heat generator is secured), while a contact piece 74 for power supply has been attached to the holding member 64 via the elastic member 73.

When the heating plate 61 is mounted on the holding member 64 to be held thereby, the contact terminal 63*p* of the heat generator 63 and the contact piece 74 for power supply of the holding member 64 are brought in contact with each other so that a power supply circuit is formed.

In the structure, the mere mounting of the heating plate 61 on the holding member 64 completes the power supply circuit simultaneously so that an additional operation of connecting a lead wire to the heat generator 63 or the like is unnecessary. Since a lead wire is not soldered, the degradation of the heating plate 61, the electric insulating layer 62, the heat generator 63, and the like caused by heat resulting from a soldering operation can be prevented.

Thus, in the belt-type fixing device according to the present invention, the fixing belt is entrained about the heating plate to be heated by the heating plate. As the heat generator as the heat source of the heating plate, a resistance heat generator or an electromagnetic induction heater is used. Since the heat capacity of the heating plate can be reduced significantly compared with the case where the conventional fixing roller is used, the fixing belt can be heated promptly to a temperature suitable for fixing so that a waiting time from the time of power-on is reduced.

Moreover, since it is sufficient to heat the fixing belt by energizing the heating plate only when the fixing device performs the fixing operation, a high heat efficiency is achieved so that useless heat dissipation to the outside during standby is prevented. This achieves the large effect of reducing energy consumption.

Furthermore, the supply of heat from the heating plate to the fixing belt is performed reliably and a proper tension can be given to the fixing belt during a fixing operation.

The present invention also achieves the prominent effect of providing a low-cost fixing device suitable for use in a compact image forming apparatus since the fixing device is small in size and weight and has a reduced number of components and the waiting time from the time of power-on until the fixing process is enabled is short.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A belt-type fixing device comprising:

a heating plate having a sheet-like resistance heat generator for generating heat with a supply of power and a curved surface with which a fixing belt comes in sliding contact;

a pressing pad having an elastic portion with which the fixing belt comes in sliding contact:

the fixing belt entrained in spanning and tensioned relation between said heating plate and said pressing pad; and a pressing roller imparted with a pressure given toward said pressing pad with said fixing belt interposed therebetween and driven to rotate, wherein a recording medium having a toner adhered thereto is conveyed to a nip portion between said fixing belt and said pressing roller and subjected to a fixing process.

2. The belt-type fixing device according to claim 1, further comprising:

a temperature sensing unit for sensing a temperature of said heating plate; and a control unit for controlling the power supplied to the resistance heat generator based on the temperature sensed by said temperature sensing unit.

3. The belt-type fixing device according to claim 2, wherein said temperature sensing unit senses the temperature of the heating plate at a position downstream in a direction of rotation of the fixing belt.

4. The belt-type fixing device according to claim 1, wherein said pressing pad is a heat-resistant sponge.

5. The belt-type fixing device according to claim 1, wherein said heating plate is supported rotatably around a support shaft parallel to a driving shaft of the pressing roller and the support shaft is positioned higher in level than a centroid of the heating plate and external to the centroid.

6. The belt-type fixing device according to claim 1, wherein said heating plate is composed of at least a semi-cylindrical plate base made of a heat conductive material and a heat generator disposed on a surface of the plate base opposite to a surface thereof in contact with said fixing belt, and said heating plate is held by a holder disposed to cover said heat generator at a distance therefrom.

7. A belt-type fixing device comprising:

an electromagnetic induction coil supplied with power for heating;

a heating plate having a heat generator for generating heat by using the electromagnetic induction coil and a curved surface with which a fixing belt comes in sliding contact;

a pressing pad having an elastic portion with which the fixing belt comes in sliding contact;

the fixing belt entrained in spanning and tensioned relation between said heating plate and said pressing pad; and a pressing roller imparted with a pressure given toward said pressing pad with said fixing belt interposed therebetween and driven to rotate, wherein a recording medium having a toner adhered thereto is conveyed to a nip portion between said fixing belt and said pressing roller and subjected to a fixing process.

8. The belt-type fixing device according to claim 7, further comprising:

a temperature sensing unit for sensing a temperature of said heating plate; and a control unit for controlling the power supplied to the electromagnetic induction coil based on the temperature sensed by said temperature sensing unit.

9. The belt-type fixing device according to claim 7, wherein said temperature sensing unit senses the temperature of the heating plate at a position downstream in a direction of rotation of the fixing belt.

10. The belt-type fixing device according to claim 7, wherein said pressing pad is a heat resistant sponge.

11. The belt-type fixing device according to claim 7, wherein said heating plate is supported rotatably around a support shaft parallel to a driving shaft of the pressing roller and the support shaft is positioned higher in level than a centroid of the heating plate and external to the centroid.

12. The belt-type fixing device according to claim 7, wherein said heating plate is composed of at least a semi-cylindrical plate base made of a heat conductive material and a heat generator disposed on a surface of the plate base opposite to a surface thereof in contact with said fixing belt and said heating plate is held by a holder disposed to cover said heat generator at a distance therefrom.

13. A belt-type fixing device comprising:

a heater for generating heat with a supply of power;

a support member about which a fixing rotator is entrained;

the fixing rotator entrained rotatably in spanning and tensioned relation between said heater and said support member; and a pressing rotator pressed against said support member with said fixing rotator interposed therebetween, wherein said heater is supported rotatably around a heater support shaft parallel to a driving shaft of said pressing rotator and the support shaft is positioned higher in level than a centroid of the heater and external to the centroid.

14. The belt-type fixing device according to claim 13, wherein said heater support shaft is positioned on a side opposite to an outer surface of the heater about which said fixing rotator is entrained and downstream in a direction of movement of the fixing rotator.

15. The belt-type fixing device according to claim 13, wherein said heater has an outer surface in contact with said entrained fixing rotator formed into a generally semi-cylindrical configuration and has a heat source provided on an inner surface thereof.

16. The belt-type fixing device according to claim 13, wherein said support member is a support member positioned in fixed relation so as not to move relative to said entrained fixing rotator.

17. The belt-type fixing device according to claim 13, wherein said fixing rotator is moved in conjunction with the pressing rotator by a frictional force between itself and the pressing rotator pressed against said support member.

18. The belt-type fixing device according to claim 13, wherein said heater is composed of at least a semi-cylindrical plate base made of a heat conductive material and a heat generator disposed on a surface of the plate base opposite to a surface thereof in contact with said fixing rotator and said heater is held by a holder disposed to cover said heat generator at a distance therefrom.

19. A belt-type fixing device comprising:

a heating plate for generating heat with a supply of power;

a support member about which a fixing rotator is entrained;

the fixing rotator entrained rotatably in spanning and tensioned relation between said heating plate and said support member; and a pressing rotator pressed against said support member with said fixing rotator interposed therebetween, wherein said heating plate is composed of at least a semi-cylindrical plate base made of a heat conductive material and a heat generator disposed on a surface of the plate base opposite to a surface thereof in contact with said fixing rotator, and said heating plate is held by a holder disposed to cover said heat generator at a distance therefrom.

20. The belt-type fixing device according to claim 19, wherein said holder holds the heating plate at either or each of an end portion in a circumferential direction of said semi-cylindrical heating plate and an end portion in an axial direction of the semi-cylindrical heating plate.

21. The belt-type fixing device according to claim 19, wherein said holder is disposed on a side of said heating plate on which the heat generator is disposed and holds the heating plate at least at an end portion in a circumferential direction of the heating plate and at a center portion thereof.

22. The belt-type fixing device according to claim 19, wherein a temperature sensing element for sensing a temperature of the heat generator of said heating plate is disposed in said holder in contact relation to the heat generator.

23. The belt-type fixing device according to claim 19, wherein said heating plate has an electric insulating layer disposed between said plate base and said heat generator and the electric insulating film extends outwardly from at least an end portion of the heat generator by a specified dimension.

* * * * *